United States Patent [19]

Ronchi née Marchesin

[11] Patent Number: 4,836,145

[45] Date of Patent: Jun. 6, 1989

[54] INSTANT STEAM GENERATOR FOR DOMESTIC AND PROFESSIONAL USE

[76] Inventor: Elena Ronchi née Marchesin, via Umberto Giordano 5, 20090 Trezzano Sul Naviglio (Prov. di Milano), Italy

[21] Appl. No.: 82,005

[22] Filed: Aug. 5, 1987

[51] Int. Cl.[4] ..... F22B 1/00

[52] U.S. Cl. ..... 122/4 A; 126/379; 219/271; 219/275; 222/146.5

[58] Field of Search ..... 122/4 A, 13 A, 235 F; 219/271, 273, 275; 222/146.5; 126/379

[56] References Cited

U.S. PATENT DOCUMENTS

| | | | |
|---|---|---|---|
| 810,632 | 1/1906 | Faherty et al. | 122/379 |
| 4,572,943 | 2/1986 | Hogfeldt | 219/275 X |
| 4,637,346 | 1/1987 | Draper et al. | 122/4 A |

*Primary Examiner*—Edward G. Favors

*Attorney, Agent, or Firm*—Guido Modiano; Albert Josif

[57] ABSTRACT

The instant steam generator comprises a body wherein is embedded a heater element and which defines a cavity which constitutes a vaporization chamber. The cavity is connected to a water injection coupling and to a steam emission coupling. A drop-breaker device is removably accommodatable in the cavity for the complete vaporization of the water introduced.

5 Claims, 1 Drawing Sheet

INSTANT STEAM GENERATOR FOR DOMESTIC AND PROFESSIONAL USE

BACKGROUND OF THE INVENTION

The present invention relates to an instant steam generator for domestic and professional use.

As is known, in many fields of application, such as for example steam-ironing devices, devices for cleaning tiles and the like, devices for cleaning carpets, moquette and fabrics, devices for cleaning glass panes and washable surfaces generally, devices for the humidification of rooms, as well as in devices which require the generation of steam both for domestic and for industrial use, steam generators are currently used which comprise a boiler, which contains a certain amount of water which is heated until it reaches its vaporization temperature.

With such types of steam generators, complex control systems are required to prevent the onset of overpressures which may create dangerous breakages or explosions of the boiler.

Such generators furthermore require careful and cautious use, since lack of maintenance or errors in operation on the part of the user can cause even considerable damage.

Moreover, such types of generator have a considerable thermal inertia, which is due to the need to heat the entire mass of water, regardless of the fact that a more or less reduced amount of steam is to be used.

In order to try and overcome these disadvantages, so-called instant steam generators have been made available on the market, wherein vaporization is obtained by introducing a limited amount of water inside a vaporization chamber, where the water is immediately vaporized, consequently allowing a greater versatility in use.

Known instant generators currently have considerable problems in manufacture and in the correct control of the temperature since their manufacture has not been conveniently rationalized, consequently leading to considerable problems both in manufacture and in energy waste during their operation.

Another disadvantage found in known generators is due to the fact that the removal of the unavoidable calcareous deposits is remarkably troublesome, and this problem is found all the more in instant generators, wherein the surfaces offered by the vaporization chamber are relatively small and the calcareous deposits can consequently adversely affect the correct operating conditions even in a short time.

SUMMARY OF THE INVENTION

The aim proposed by the invention is indeed to eliminate the disadvantages described above by providing an instant steam generator for domestic and professional use which allows to obtain the generation of steam in a vaporization chamber which, though it has relatively small dimensions, is capable of having a considerable efficiency by virtue of a contact surface which is adequately increased.

Within the scope of the aim described above, a particular object of the invention is to provide an instant steam generator which allows to perform simply and rapidly the removal of the calcareous deposits from the vaporization chamber, without having to make use of particular equipment and without the need to perform complicated maneuvers.

Still another object of the present invention is to provide an instant steam generator which has very compact dimensions which, besides drastically reducing the energy dispersion of heat towards the outside, also allows to achieve an extremely precise and effective adjustment and thermal control.

Another object of the present invention is to provide an instant steam generator which eliminates any possible danger for the user, even in the case of improper use, since the reduced amount of water which is vaporized from time to time cannot create dangerous pressure values even in case, for any reason, the steam outlet becomes occluded.

Not least object of the invention is to provide an instant steam generator which is easy and economical to manufacture with an extremely small number of processes and components, without the use of skilled labor or of complex technology, and furthermore having the possibility of being easy and rapid to replace.

The above described aims and objects, as well as others which will become apparent hereinafter, are achieved by an instant steam generator for domestic and professional use, according to the invention, characterized in that it comprises a body wherein is accommodated a heater element and which defines a cavity constituting the vaporization chamber, said cavity being connected to a water injection coupling and to a steam emission coupling, in said cavity there being removably accommodatable a drop-breaker device for the complete vaporization of the water introduced.

BRIEF DESCRIPTION OF THE DRAWINGS

Further characteristics and advantages will become apparent from the description of a preferred, but not exclusive, embodiment of an instant steam generator for domestic and professional use, illustrated only by way of non-limitative example in the accompanying drawings, wherein.

FIG. is a schematic perspective view, partially cutaway, of the instant generator according to the invention.

DESCRIPTION OF THE PREFERRED EMBODIMENTS

Figure 1:
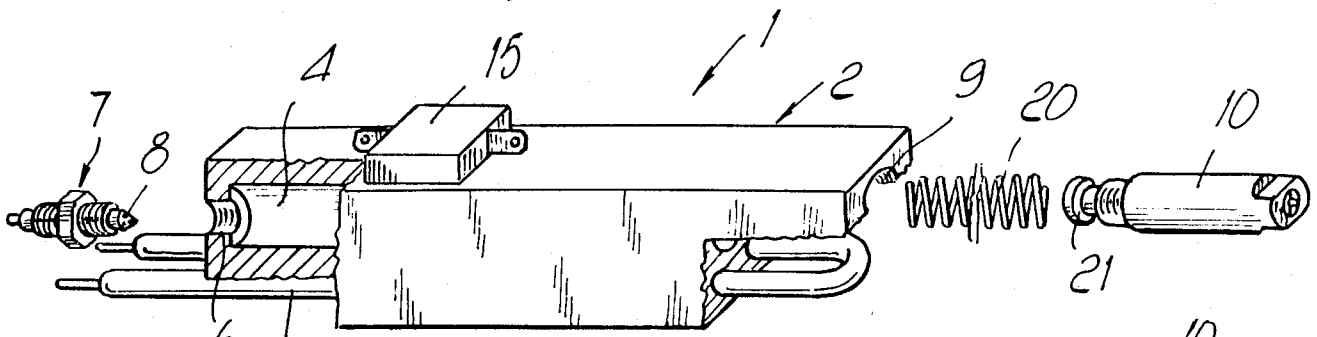

With reference to the above described figures, the instant steam generator for domestic and professional use, generally indicated by the reference numeral 1, comprises a body 2 which preferably has a substantially prismatic configuration and consists of a casting in thermally conducting material which includes, in its interior, a heater element, consisting of an armored and embedded electric resistor, indicated by 3.

The body 2 defines, in its interior, a cavity 4 which extends longitudinally in said body and which is advantageously positioned proximate to the extension of the armored resistor 3.

Advantageously, the cavity 4 has a constant cross section and is substantially cylindrical.

At a first end, the cavity 4 is provided with a threaded inlet 6 whereto engages an injection coupling 7 which is provided, in its interior, with an insert 8 provided with small spraying holes. The insert 8 is preferably made of thermally insulating and lubricating material, such as Teflon or the like, which rejects calcareous deposits.

At the second end, the cavity 4 is provided with a threaded outlet 9 whereto can be applied steam emission couplings which can have any configuration and which are generally indicated by the reference numeral 10.

Figure 3:
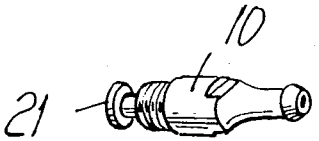
FIG. 3 is a view of a different embodiment of the emission coupling.
Figure 2:
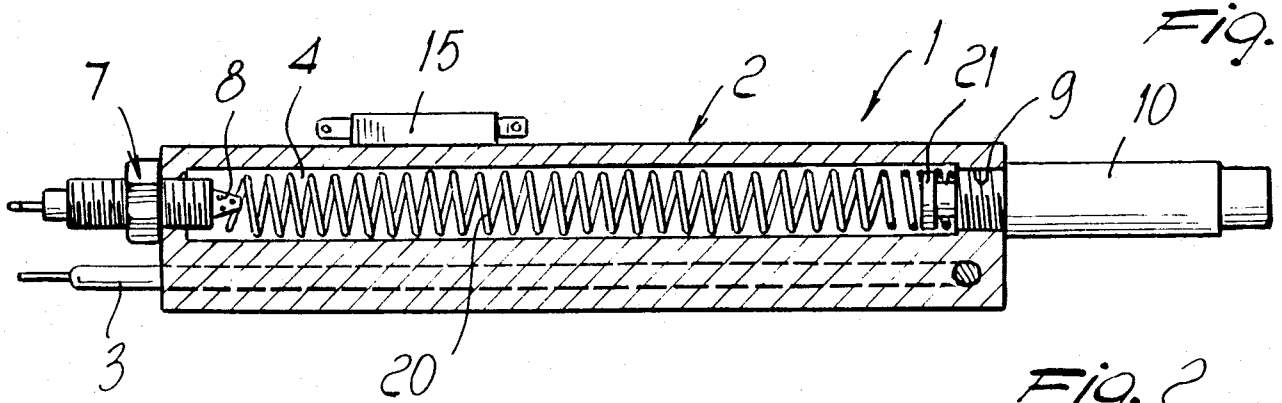
FIG. 2 is a cross section view of the instant generator.

The steam emission couplings 10 are also preferably made of Teflon and have different configurations according to the particular application; thus, for example, the coupling illustrated in FIG. 1 is used for the delivery and use of the steam in the same conditions in which it is produced, while the coupling illustrated in FIG. 3 is adapted for its connection to a tube for the conveyance of the steam to a user device which can, for example, consist of an iron.

A thermostat, indicated by 15, is applied to the outer surface of the prismatic body 2, in close contact therewith, and has the function of controlling the operation of the heater element, providing its switching on and off every time the extremes of the thermal setting interval are reached.

The important peculiarity of the invention resides in the fact that a drop-breaker device is accommodated inside the cavity 3 and allows the complete vaporization of the water introduced; said drop-breaker device, in a preferred embodiment, consists of a metallic wire coiled in a helix, indicated by 20, which extends longitudinally inside said cavity 4.

Said helical wire 20 performs another extremely important function, namely that of considerably increasing the surfaces inside the cavity, in practice increasing the surfaces whereon the deposition of calcareous matter can occur.

Said helical wire 20 is connected, at its end, to a tang 21 which is provided directly on the emission couplings, so that by disassembling the emission couplings one can easily and rapidly extract the wire 20 to allow the removal of calcareous matter, which can be obtained simply by striking said wire, then having the possibility of introducing a tube-brush or another similar element to perform the cleaning of the walls of the cavity, facilitated by the fact that the cavity is perfectly cylindrical.

In practical use, as soon as water is sent to the water injection coupling 7, being introduced through the nozzles provided on the insert 8, making contact with the inner surface of the vaporization chamber consisting of the cavity 4, which is kept at operating temperature by the action of the heater resistor 3, which is controlled by the thermostat 15, it instantly vaporizes and is introduced in the direction of the steam emission coupling.

The steam emission coupling, as illustrated in FIG. 1, can be possibly provided with a diaphragm the passage section whereof is conveniently adjustable so as to vary the volume of the steam discharge chamber, thus obtaining a variation in the speed and temperature of said steam.

Any droplets carried along by the flow of steam along the cavity 4 are intercepted by the drop-breaker element consisting of the helically coiled wire 20 and are therefore also vaporized.

By simply removing the coupling 10, the drop-breaker element connected thereto is also simultaneously removed, enormously simplifying the operation of periodic cleaning of the chamber, since part of the residual of calcareous deposits is present directly on the wire 20, and the remaining part, which deposits on the walls of the cavity, is easily removable.

From what has been described, it can thus be observed that the invention achieves the intended aims and objects, and in particular the fact is stressed that the presence of a drop-breaker device, consisting of a wire coiled in a spiral, allows both to prevent the emission of drops together with the steam, and to increase the contact surfaces inside the vaporization chamber, consequently facilitating the distribution of calcareous deposits, as well as their easy extraction, during the cleaning of the cavity.

The invention thus conceived is susceptible to numerous modifications and variations, all of which are within the scope of the inventive concept.

Moreover, all the details may be replaced with technically equivalent elements.

In practice, the materials employed, so long as compatible with the specific use, as well as the dimensions and the contingent shapes, may be any according to the requirements.

I claim:

1. Instant steam generator for domestic and professional use, comprising a body accommodating a heater element and defining a cavity, said cavity having a first end, a second end, and defining a vaporization chamber, said vaporization chamber having a useful surface, said cavity being connected to a water injection coupling and a steam emission coupling, said water injection coupling being arranged at said first end coaxially to said steam emission coupling said steam emission coupling being arranged at said second end, in said cavity there being removably accommodated a drop-breaker device said drop-breaker device being adapted for causing complete vaporization of the water introduced into said vaporization chamber and for increasing said useful surface of said vaporization chamber.

2. Instant steam generator, according to claim 1, wherein said steam emission coupling has a tang, and wherein said drop-breaker device comprises a wire coiled to define a cylindrical helix having at least one end and at least one other end, said at least one end being connected to said tang of said steam emission coupling.

3. Instant steam generator, according to claim 1, wherein said body has a substantially prismatic configuration and wherein said cavity has a substantially cylindrical configuration.

4. Instant steam generator, according to claim 2, wherein said wire coiled to define said cylindrical helix extends substantially longitudinally inside said cavity parallel to said heater element.

5. Instant steam generator, according to claim 1, further comprising a thermostat, said thermostat being adapted for controlling said heater element, said heater element being directly associated by contact with a portion of said body located nearest to said cavity and farthest from said heater element.

* * * * *